US010085309B2

(12) United States Patent
Zhou et al.

(10) Patent No.: US 10,085,309 B2
(45) Date of Patent: Sep. 25, 2018

(54) DRAWER-TYPE MICROWAVE OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Jianyi Zhou, Foshan (CN); Yongzhong Zhang, Foshan (CN); Jian Long, Foshan (CN)

(73) Assignee: GUANGDONG MIDEA KITCHEN APPLIANCES MANUFACTURING CO., LTD., Foshan (CN)

( * ) Notice: Subject to any disclaimer, the term of this patent is extended or adjusted under 35 U.S.C. 154(b) by 145 days.

(21) Appl. No.: 14/865,598

(22) Filed: Sep. 25, 2015

(65) Prior Publication Data

US 2017/0086263 A1 Mar. 23, 2017

(30) Foreign Application Priority Data

Sep. 21, 2015 (CN) ..... 2015 1 0603569
Sep. 21, 2015 (CN) ..... 2015 2 0731405

(51) Int. Cl.
*H05B 6/64* (2006.01)
*H05B 6/68* (2006.01)

(52) U.S. Cl.
CPC ..... *H05B 6/6417* (2013.01); *H05B 6/6402* (2013.01); *H05B 6/6414* (2013.01); *H05B 6/68* (2013.01)

(58) Field of Classification Search
CPC ..... H05B 6/6417; H05B 6/68; H05B 6/6402
(Continued)

(56) References Cited

U.S. PATENT DOCUMENTS 7,414,225 B2 8/2008 Yoshidome et al.
7,919,735 B2 * 4/2011 Kiyono ..... F24C 15/022 219/690

(Continued)

FOREIGN PATENT DOCUMENTS

CN 1428116 A 7/2003
CN 203595158 U 5/2014

(Continued)

OTHER PUBLICATIONS

Chinese Patent Application No. 201510603569.1, First Office Action and English Translation thereof, dated Sep. 5, 2016, 11 pages.

(Continued)

*Primary Examiner* — David Angwin
*Assistant Examiner* — Biniam Asmelash
(74) *Attorney, Agent, or Firm* — Lathrop Gage L.L.P.

(57) ABSTRACT

A drawer-type microwave oven includes: an oven body, defining an oven cavity therein, and provided with a first microswitch, a second microswitch and a locking engagement component thereon; a drawer, connected to the oven body, disposed in the oven cavity and between a closed position and an opened position in a push-pull way, provided with a door at an end of the drawer for driving the door to open or close the oven cavity, and provided with a locking component rested against the first microswitch removably and a limiting component rested against the second microswitch removably; a drawer driving device, connected to the drawer; and a controller configured to control the drawer driving device to drive the drawer to be pushed into or pulled out of the oven cavity by monitoring state changes of the first microswitch and the second microswitch.

19 Claims, 8 Drawing Sheets

(58) Field of Classification Search
USPC ..... 219/392, 400, 520, 702, 741, 756, 762
See application file for complete search history.

(56) References Cited

U.S. PATENT DOCUMENTS

| | | | | |
|---|---|---|---|---|
| 8,291,816 | B2 * | 10/2012 | Iwamoto | A47J 39/00 219/391 |
| 2005/0173426 | A1 | 8/2005 | Iwamoto | |
| 2008/0288113 | A1 | 11/2008 | Nishio | |
| 2009/0200297 | A1 * | 8/2009 | Myoji | F24C 7/087 219/762 |

FOREIGN PATENT DOCUMENTS

| | | | |
|---|---|---|---|
| CN | 203642259 | A | 6/2014 |
| CN | 104456646 | A | 3/2015 |
| CN | 104566534 | A | 4/2015 |
| CN | 205026748 | U | 2/2016 |
| JP | 2002367348 | A | 12/2002 |

OTHER PUBLICATIONS

Chinese Patent Application No. 201510603569.1, Notice of Allowance and Translation thereof, dated Jan. 9, 2017, 9 pages.
PCT/CN2015/090802 International Search Report & Written Opinion with brief English translation, dated Jul. 1, 2016, 15 pages.

* cited by examiner

DRAWER-TYPE MICROWAVE OVEN

CROSS-REFERENCE TO RELATED APPLICATIONS

This application claims priority to and benefits of the following applications:

1) Chinese Patent Application Serial No. 201510603569.1, filed with the State Intellectual Property Office of P. R. China on Sep. 21, 2015;

2) Chinese Patent Application Serial No. 201520731405.2, filed with the State Intellectual Property Office of P. R. China on Sep. 21, 2015.

The entire contents of the above applications are incorporated herein by reference.

FIELD

The present disclosure relates to the field of microwave oven technology, more particularly to a drawer-type microwave oven.

BACKGROUND

In the related art, a door opening and closing device of the drawer-type microwave oven is of a pushing structure consisting of a computer board and an electric motor. Specifically, a rack is fixed at the drawer; a gear is fixed at the electric motor, and the electric motor is fixed at the front end of the drawer's bottom. When the computer board emits a signal, the electric motor is rotated, by which the gear at the electric motor drives the rack fixed at the drawer to be moved forward or backward, thereby controlling the door to be opened or closed. The drawer-type microwave oven may be provided with an "ON/OFF" button, by which a user may control the computer board to drive the electric motor, so as to automatically open or close door. For the microwave oven being of such structure, its door may be opened or closed merely by the "ON/OFF" button, which is a simpler operation with poor flexibility.

SUMMARY

The present disclosure is accomplished by the inventor based on the discovering and understanding of the following facts and problems.

During practical application, for reasons such as the user's operation habit, when it is required to open or close door, the user usually subconsciously pulls or pushes door by hands. At this moment, those drawers which are moved only under the drive of an electric motor are not moved. As a result, the user needs to find the "ON/OFF" button again for the door opening and closing operations, which is not convenient and may cause the microwave oven to be damaged due to applying a lot of pressure. For some microwave ovens with a drawer which may be pulled or pushed by hands, it is required to apply a pressure for the door opening or closing operations, which is not convenient for the door opening or closing operations, neither.

For the convenience of user's operation, a microwave oven which may be automatically switched into an automatic door opening or closing mode from a manual door opening or closing mode appears in the related art. During opening or closing door, the user may slightly pull or push a door, so that the door may be automatically opened or closed under the drive of an electric motor after moved a certain distance, which is convenient for use. However, for these microwave ovens with such switching function, in order to detect the manual door opening or closing operations for determining user's intention, the microwave oven is usually provided with a specific receiver (such as an optocoupler) for receiving a pulse or utilizes a specific electric motor having a pulse detecting function for signal feedback, thereby determining the user's intention based on a shape of the pulse signal, and performing the door opening or closing operations by means of controlling the electric motor to drive the drawer to be moved.

These microwave ovens are of a relatively complex structure with general higher cost. For example, if the receiver is used to collect data, it requires additional cost for the corresponding receiver, and obtained determination values are not always accurate. If the specific electric motor having the pulse detecting function itself is used for signal feedback, it costs higher than an ordinary electric motor.

In view of this, the present disclosure directs to solve at least one of the technical problems existing in the related art to at least some extent. An object of the present disclosure is to provide a drawer-type microwave oven, so as to facilitate door opening or closing operations, conform to user's operation habit and reduce cost.

A drawer-type microwave oven according to embodiments of the present disclosure includes: an oven body, defining an oven cavity therein, and provided with a first microswitch, a second microswitch and a locking engagement component thereon; a drawer, connected to the oven body, disposed in the oven cavity and between a closed position and an opened position in a push-pull way, provided with a door at an end of the drawer for driving the door to open or close the oven cavity, and provided with a locking component rested against the first microswitch removably and a limiting component rested against the second microswitch removably; a drawer driving device, connected to the drawer; and a controller, electrically connected to the drawer driving device, the first microswitch and the second microswitch respectively, and configured to control the drawer driving device to drive the drawer to be pushed into or pulled out of the oven cavity by monitoring state changes of the first microswitch and the second microswitch.

For the drawer-type microwave oven according to embodiments of the present disclosure, the locking component and the limiting component may be rested against or detached from the first microswitch and the second microswitch respectively with the movement of the drawer, so that an opening or closing state of the first microswitch and the second microswitch may be changed with the movement of the drawer; besides the controller may determine the position where the drawer is located and the user's intention by detecting changes between opening and closing, by which it is no longer required to detect the position where the drawer is located with a pulse receiver or specific electric motor, thereby significantly reducing cost, achieving the transition from the manual door opening or closing mode to the automatic door opening or closing mode, which is convenient for operations, conforms to the user's habit and improves the comfortability.

In addition, the drawer-type microwave oven according to embodiments of the present disclosure may further have the following additional technical features.

In an embodiment, when the drawer is moved to the closed position, the locking component engages with the locking engagement component so as to lock the door, so that the locking component is rested against the first microswitch so as to close the first microswitch and the controller controls the drawer driving device to stop moving; and when the drawer is moved to the opened position from the closed position, the locking component is detached from the locking engagement component, so that the first microswitch is shut off and the controller controls the drawer driving device to drive the drawer to be pulled out of the oven cavity. Alternatively, when the drawer is moved to the opened position, the limiting component is rested against the second microswitch so as to close the second microswitch, so that the controller controls the drawer driving device to stop moving; and when the drawer is moved to the closed position from the opened position, the limiting component is detached from the second microswitch, so that the second microswitch is shut off and the controller controls the drawer driving device to drive the drawer to be pushed into the oven cavity.

In an embodiment, when the drawer is moved to the closed position, the locking component engages with the locking engagement component so as to lock the door, so that the locking component is rested against the first microswitch so as to shut off the first microswitch and the controller controls the drawer driving device to stop moving; and when the drawer is moved to the opened position from the closed position, the locking component is detached from the locking engagement component, so that the first microswitch is closed and the controller controls the drawer driving device to drive the drawer to be pulled out of the oven cavity. Alternatively, when the drawer is moved to the opened position, the limiting component is rested against the second microswitch so as to shut off the second microswitch, so that the controller controls the drawer driving device to stop moving; and when the drawer is moved to the closed position from the opened position, the limiting component is detached from the second microswitch, so that the second microswitch is closed and the controller controls the drawer driving device to drive the drawer to be pushed into the oven cavity.

In an embodiment, the drawer driving device comprises: an electric motor, connected to the controller, so as to be rotated in a forward or reverse direction under a control of the controller; a pusher, connected to the electric motor; and a pushing rod, connected to the pusher and the drawer, so as to drive the drawer to be moved.

In an embodiment, the oven body is provided with a guide rail thereon, the drawer is provided with a guide rail connecting plate thereon, and the guide rail connecting plate is connected to the guide rail slidably.

In an embodiment, the limiting component is disposed on the guide rail connecting plate.

In an embodiment, the locking component is disposed on the door and configured as a hook, the oven body is provided with an interlocking bracket thereon, and the locking engagement component is disposed on the interlocking bracket and configured as a snapping plate.

In an embodiment, the hook, formed into an L-like shape, comprises a connection part and a snapping part, wherein the connection part is connected to the door; and the snapping part is rested against the first microswitch removably, has a slope engaging with the snapping plate which is inclinedly arranged relative to a vertical direction.

In an embodiment, the first microswitch and the second microswitch are disposed on the interlocking bracket.

In an embodiment, the interlocking bracket comprises a left interlocking bracket and a right interlocking bracket, the locking component comprises a left locking component and a right locking component, the first microswitch and the second microswitch are disposed on the right interlocking bracket, the right interlocking bracket is rested against the first microswitch removably, the left interlocking bracket is provided with a third microswitch connected to the controller, and the left interlocking bracket is rested against the third microswitch removably.

In an embodiment, the oven body is provided with a control switch connected to the controller, so as to control the drawer driving device to operate under a control of the control switch.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
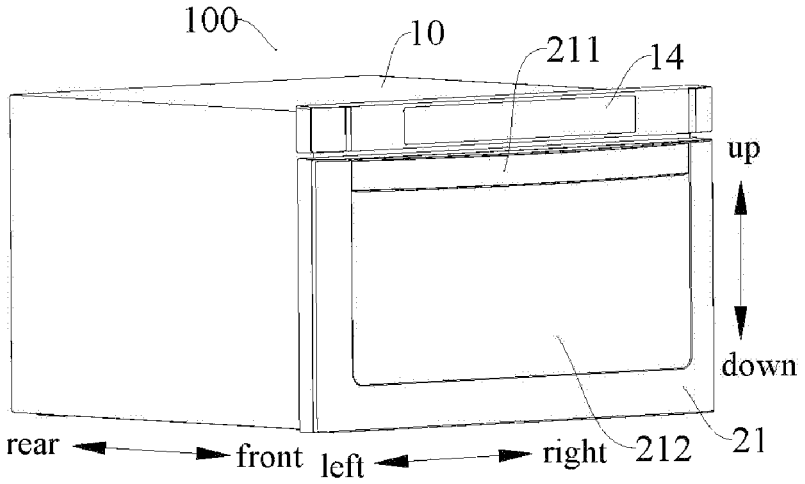
FIG. 1 is a schematic view showing a drawer-type microwave oven according to an embodiment of the present disclosure.

Reference will be made in detail to embodiments of the present disclosure. The embodiments described herein with reference to drawings are explanatory, illustrative, and used to generally understand the present disclosure.

The drawer-type microwave 100 according to embodiments of the present disclosure is described in detail in conjunction with drawings below.

Referring to FIGS. 1-9, the drawer-type microwave 100 according to embodiments of the present disclosure may include an oven body 10, a drawer 20 and a drawer driving device 30.

The oven body 10 defines an oven cavity therein, and may also be provided with a first microswitch 41, a second microswitch 42 and a locking engagement component 11. The drawer 20 is connected to the oven body 10 and disposed in the oven cavity and between a closed position and an opened position in a push-pull way. The drawer 20 is provided with a door 21 at an end thereof, so that the drawer 20 may drive the door 21 to open or close the oven cavity. Specifically, when the drawer 20 is in the opened position, the door 21 may open the oven cavity; and when the drawer 20 is in the closed position, the door 21 may close the oven cavity.

The drawer 20 may be provided with a locking component 22 and a limiting component 23 thereon. The locking component 22 may be rested against the first microswitch 41 removably. The limiting component 23 may be rested against the second microswitch 42 removably. The drawer driving device 30 is connected to the drawer 20. The controller 15 is electrically connected to the drawer driving device 30, the first microswitch 41 and the second microswitch 42 respectively, and configured to control the drawer driving device 30 to drive the drawer 20 to be pushed into or pulled out of the oven cavity by monitoring state changes of the first microswitch 41 and the second microswitch 42.

For the drawer-type microwave oven 100 according to embodiments of the present disclosure, the oven body 10 is provided with the drawer driving device 30, the first microswitch 41 and the second microswitch 42 which are connected to the controller 15 respectively; the drawer 20 is provided with the locking component 22 and the limiting component 23, which may be rested against or detached from the first microswitch 41 and the second microswitch 42 respectively with the movement of the drawer 20, so as to cause state changes of the first microswitch 41 and the second microswitch 42; and the controller 15 controls the drawer driving device 30 to drive the drawer 20 to be pushed into or pulled out of the oven cavity by monitoring state changes of the first microswitch 41 and the second microswitch 42, so as to achieve a transition from a manual door opening or closing mode to an automatic door opening or closing mode, which is convenient for the door opening or closing operations. Therefore, it is possible to detect a position where the drawer is located for determining the user's intention by a mechanical structure instead of a pulse receiver or a specific electric motor, and thereby to reduce cost significantly, to facilitate the door opening or closing operations, to conform to user's operation habit and to improve comfortability.

As shown in FIGS. 3-6, when the drawer 20 is moved to the closed position, the locking component 22 may engage with the locking engagement component 11, so as to lock the door 21, so that the locking component 22 may be rested against the first microswitch 41, so as to close the first microswitch 41 and the controller 15 may control the drawer driving device 30 to stop moving. In other words, when the drawer 20 is moved to the closed position, the door 21 may close the oven cavity, and the locking component 22 may engage with the locking engagement component 11 to form a locking mechanism, so that the door 21 may be locked closely and may not easy to move; at the same time, the locking component 22 may also be rested against the first microswitch 41. Specifically, the locking component 22 may be rested against a contact of the first microswitch 41, so as to close the first microswitch 41. When the first microswitch 41 is closed, the controller 15 controls the drawer driving device 30 to stop operating, so that the drawer 20 and the door 21 may be at the close position steadily, resulting in a safety and reliable use.

When the drawer 20 is moved to the opened position from the closed position, the locking component 22 may be detached from the locking engagement component 11, so that the first microswitch 41 is shut off. When the controller 15 monitors that the first microswitch 41 is changed into an off-state from a closed state, and determines that the user's intention is to open door, then the controller 15 emits a door opening signal to the drawer driving device 30, so as to control the drawer driving device 30 to drive the drawer 20 to be pulled out of the oven cavity. In other words, when the drawer 20 is moved to the opened position from the closed position, the locking component 22 may be detached from the locking engagement component 11, and no longer rested against the first microswitch 41, as a result, the first microswitch 41 is shut off. The controller 15 monitors that the first microswitch 41 is changed into an off-state from a closed state, and determines that the user's intention is to open door, then the controller 15 may send an instruction to the drawer driving device 30, so as to enable the drawer driving device 30 to operate, and thereby to drive the drawer 20 to be moved to the opened position, i.e., the drawer 20 is gradually pulled out of the oven cavity.

Figure 7:
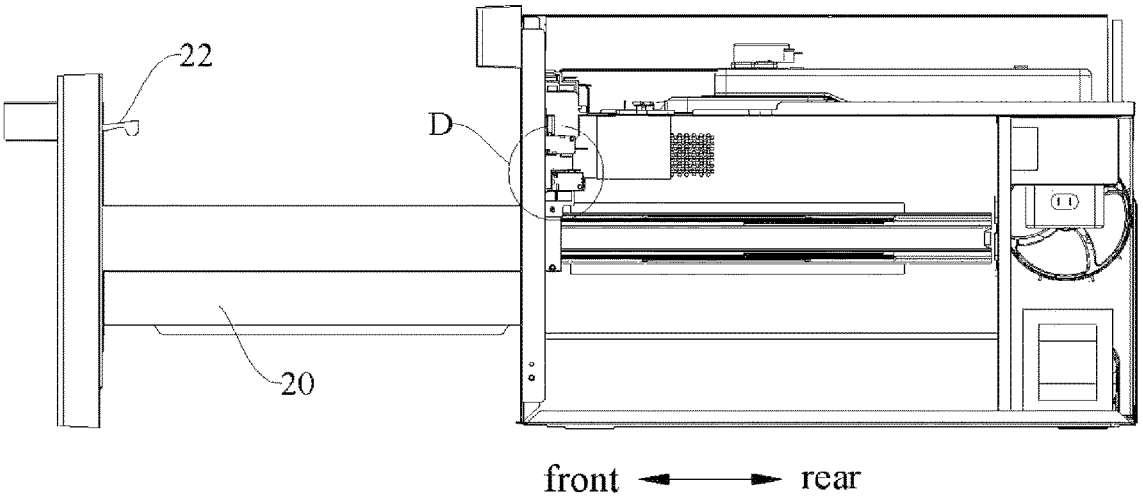
FIG. 7 is a side view showing a drawer-type microwave oven in a closed position according to an embodiment of the present disclosure.
Figure 8:
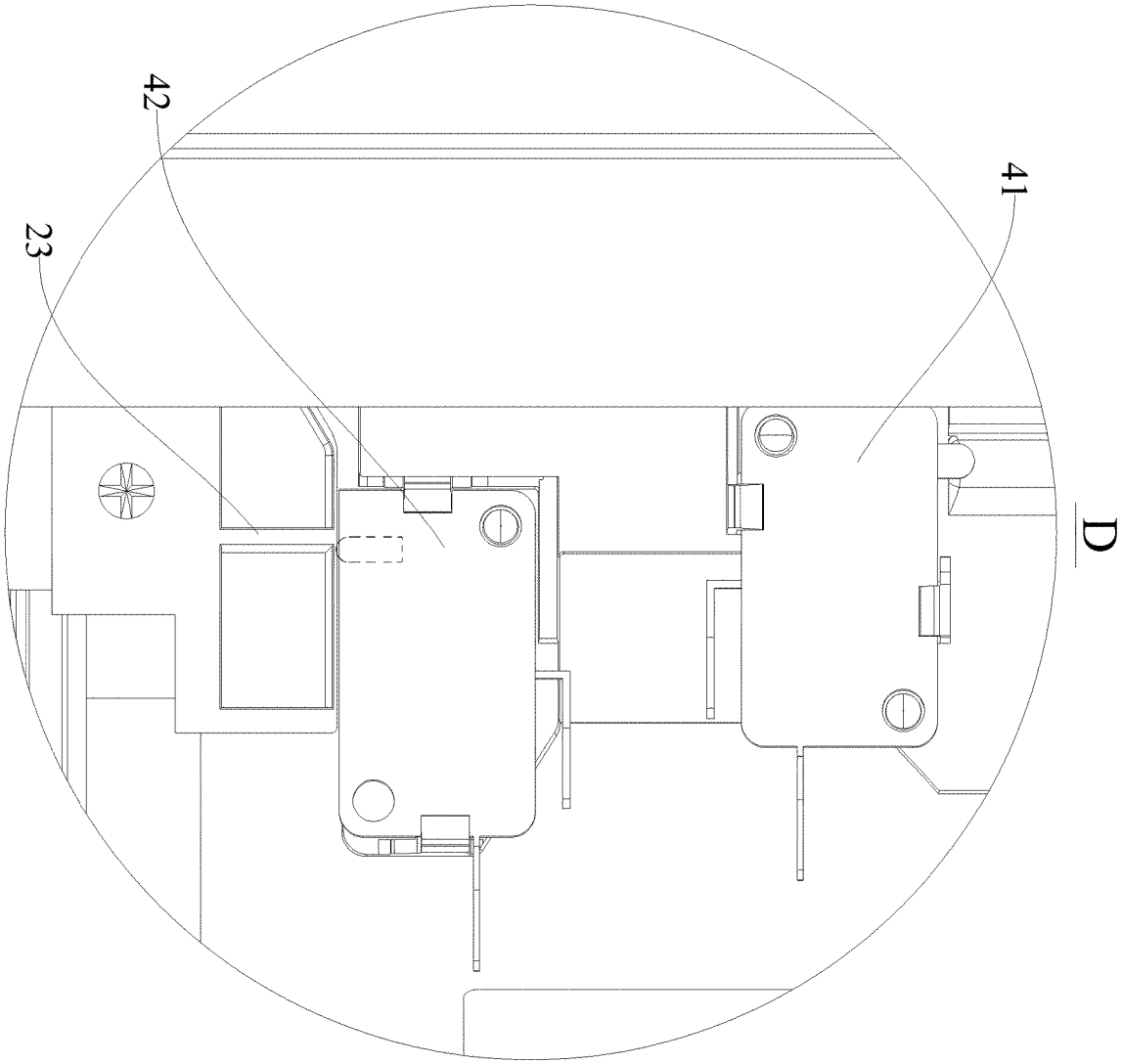
FIG. 8 is a schematic enlarged view showing a D region in FIG. 7.
Figure 9:
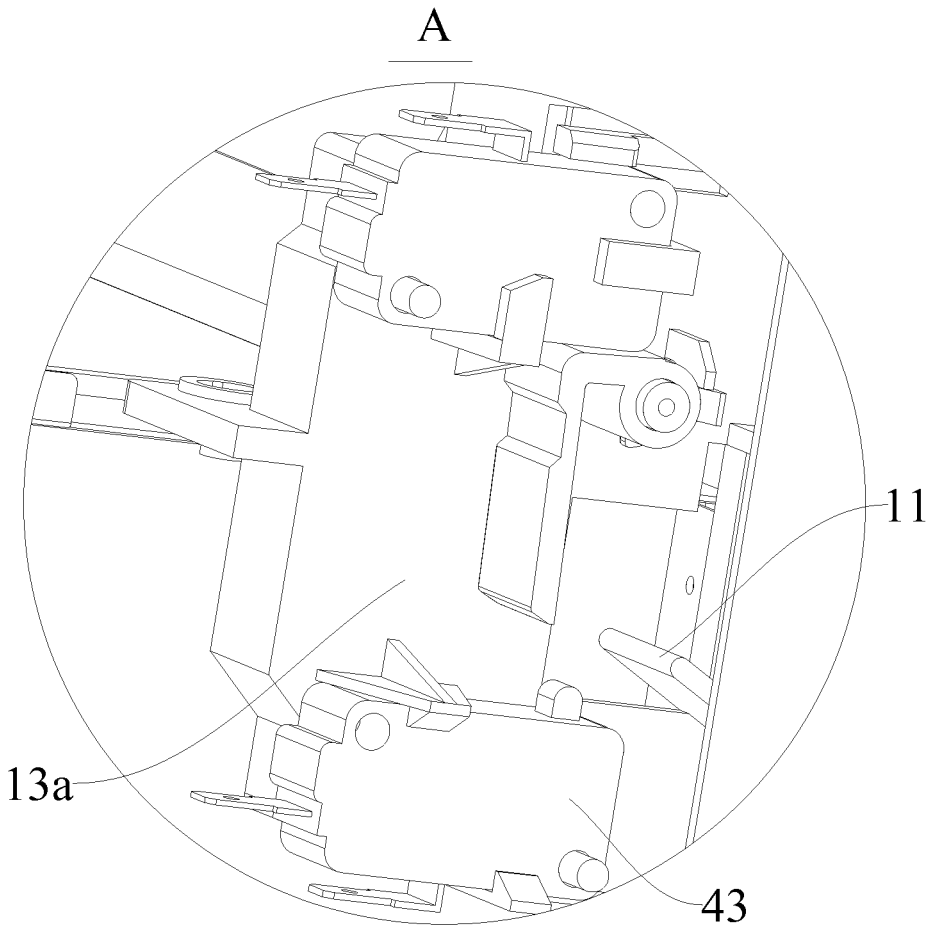
FIG. 9 is a schematic enlarged view showing an A region in FIG. 2.

As shown in FIGS. 7-8, when the drawer 20 is moved to the opened position, the limiting component 23 may be rested against the second microswitch 42, so as to close the second microswitch 42, so that the controller 15 may control the drawer driving device 30 to stop moving. Specifically, the limiting component 23 may be rested against a contact of the second microswitch 42, when the second microswitch 42 is closed, the controller 15 may send an instruction to the drawer driving device 30, so as to control the drawer driving device 30 to stop operating, so that the drawer 20 and the door 21 may be in the opened position steadily.

When the drawer 20 is moved to the closed position from the opened position, the limiting component 23 is detached from the second microswitch 42, so that the second microswitch 42 is shut off, and the controller 15 may control the drawer driving device 30 to drive the drawer 20 to be pushed into the oven cavity. In other words, when the drawer 20 is moved to the closed position from the opened position, the limiting component 23 is detached from the second microswitch 42, so that the second microswitch 42 is shut off and the controller 15 monitors that the second microswitch 42 is changed into an off-state from a closed state and determines that the user's intention is to close door, then the controller 15 sends an instruction to the drawer driving device 30, so as to control the drawer driving device 30 to drive the drawer 20 to be moved to the closed position, so that the drawer 20 is pushed into the oven cavity gradually.

Accordingly, when the user needs to open door, the drawer 20 may be moved by means of pulling with hands in the beginning, when the locking component 22 is detached from the locking engagement component 11 and no longer rested against the first microswitch 41, when the first microswitch 41 is shut off, the drawer driving device 30 operates and drives the drawer 20 to be moved to the opened position, as a result, it is not required to fully manually open door by means of applying a force with hands during the door opening operations. The drawer-type microwave oven 100 may be changed into the automatic door opening mode from the manual door opening mode, such that the door may be opened steadily with saved labor. At the same time, when the drawer 20 is moved to the opened position, the limiting component 23 may be rested against the second microswitch 42, so as to close the second microswitch 42 and enable the drawer driving device 30 to stop operating, as a result, it is not required to stop operation manually, resulting in high automaticity and convenient use.

Similarly, when the user needs to close door, the drawer 20 may be moved by means of pushing with hands in the beginning, when the limiting component 23 is detached from the second microswitch 42, the second microswitch 42 is shut off, the drawer driving device 30 operates and drives the drawer 20 to be moved to the closed position, as a result, it is not required to fully manually close door by means of applying a force with hands during the door closing operations. The drawer-type microwave oven 100 may be changed into the automatic door closing mode from the manual door closing mode, such that the door may be closed steadily with saved labor. At the same time, when the drawer 20 is moved to the closed position, the locking component 22 may be rested against the first microswitch 41, so as to close the first microswitch 41, and enable the drawer driving device 30 to stop operating, as a result, it is not required to stop operation manually, resulting in high automaticity and convenient use.

In another embodiment of the present disclosure, when the locking component 22 is rested against the contact of the first microswitch 41, the first microswitch 41 may be also in the off-state, and when the locking component 22 is detached from the locking engagement component 11, the first microswitch 41 is in the closed state. When the limiting component 23 is rested against the contact of the second microswitch 42, the second microswitch 42 may be also in the off-state, and when the limiting component 23 is detached from the second microswitch 42, the second microswitch 42 is in the closed state.

In the case that the second microswitch 42 is closed, if the controller 15 monitors that the first microswitch 41 is changed into the closed state from the off-state, i.e., determines that the user's intention is to open door, then the controller 15 sends a door opening instruction to the drawer driving device 30 to operate and drive the drawer 20 to be moved to the opened position, so that the drawer 20 is pulled out of the oven cavity gradually. In the case that the first microswitch 41 is closed, if the controller 15 monitors that the second microswitch 42 is changed into the closed state from the off-state, i.e., determines that the user's intention is to close door, then the controller 15 sends a door closing instruction to the drawer driving device 30 to enable the drawer driving device 30 to operate and drive the drawer 20 to be moved to the closed position, so that the drawer 20 is pushed into the oven cavity gradually.

Alternatively, in some specific examples of the present disclosure, the controller 15 may be a computer board, which is easy to manufacture and convenient to operate.

Figure 2:
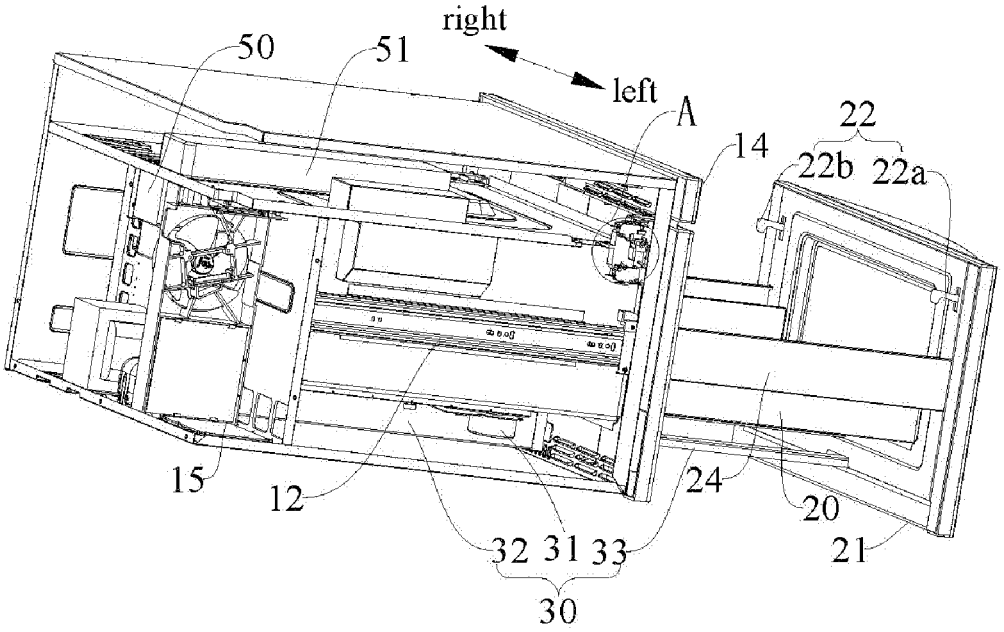
FIG. 2 is a schematic view showing a drawer-type microwave oven in an opened position according to an embodiment of the present disclosure.

The drawer driving device 30 may be of a plurality of structures. Alternatively, as shown in FIG. 2, in an embodiment of the present disclosure, the drawer driving device 30 may include an electric motor 31, a pusher 32 and a pushing rod 33. The electric motor 31 may be connected to the controller 15, so that the electric motor 31 may be rotated in a forward or reverse direction under the control of the controller 15. The pusher 32 may be connected to the electric motor 31. The pushing rod 33 may be connected to the pusher 32 and the drawer 20, so as to drive the drawer 20 to be moved.

Specifically, if the electric motor 31 is rotated in the forward direction to open door under the control of the controller 15, then the electric motor 31 is rotated in the reverse direction to close door under the control of the controller 15; whereas if the electric motor 31 is rotated in the reverse direction to open door under the control of the controller 15, then the electric motor 31 is rotated in the forward direction to close door under the control of the controller 15. The pusher 32 is connected to the electric motor 31, and the pushing rod 33 is connected to the pusher 32, so that the rotation of the electric motor 31 may be converted into a forward-and-backward movement of the pushing rod 33 by the pusher 32. Alternatively, the pusher 32 may consist of a reduction gearbox and a belt drive. The drawer 20 is connected to the pushing rod 33, so as to be moved forward and backward under the drive of the pushing rod 33, and thereby to achieve the door opening and closing operations. Such driving device is of a relative simple structure and a reliable transmission performance, which may guarantee the drawer 20 a steady and reliable movement.

As shown in FIG. 2, the drawer driving device 30 may be disposed on the bottom of the drawer 20; and an end of the pushing rod 33 may be connected to the door 21, and the other end of the pushing rod 33 may be connected to the pusher 32, thereby the pusher may not only push the drawer 20 effectively but also support the drawer 20, enabling the drawer 20 to be moved steadily.

Figure 3:
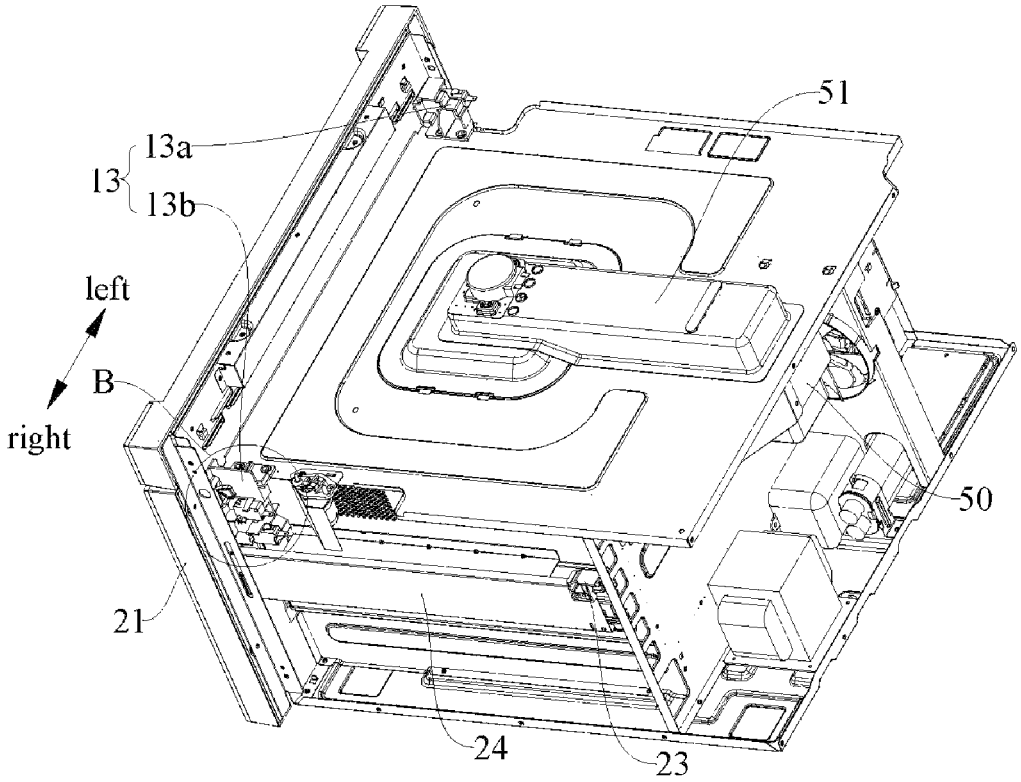
FIG. 3 is a schematic view showing a drawer-type microwave oven in a closed position according to an embodiment of the present disclosure.

Referring to FIGS. 2-3, the oven body 10 may be provided with a guide rail 12 thereon, the drawer 20 may be provided with a guide rail connecting plate 24 thereon, and the guide rail connecting plate 24 may be slidably connected to the guide rail 12. The guide rail 12 is fitted with the guide rail connecting plate 24, so as to support the drawer 20 and enable the drawer 20 to slide, so that the drawer 20 may be mounted securely and moved smoothly and steadily.

Further, the limiting component 23 may be disposed on the guide rail connecting plate 24, so that the limiting component 23 may be moved under the drive of the guide rail connecting plate 24 during moving the drawer 20, enabling the limiting component 23 to be rested against or detached from the second microswitch 42. As a result, it is not required to dispose the limiting component 23 on the drawer 20 directly, and thereby to guarantee the drawer 20 an integrity, which makes its structure more steady, and reduces manufacturing cost. Alternatively, the limiting component 23 may be disposed at an end of one guide rail connecting plate 24, for example, as shown in FIGS. 3-8, the limiting component 23 may be disposed at an end of the guide rail connecting plate 24 which is located at a right side.

Referring to FIGS. 2-8, the locking component 22 may be disposed on the door 21, the oven body 10 may be provided with an interlocking bracket 13 thereon, and the locking engagement component 11 may be disposed on the interlocking bracket 13, which not only facilitates manufacture but also guarantees the oven body 10 and the drawer 20 the structural integrity. Alternatively, the locking component 22 may be configured as a hook, and the locking engagement component 11 may be configured as a snapping plate, which not only facilitates manufacture but also ensures that the locking component 22 and the locking engagement component 11 engage well with each other.

Figure 4:
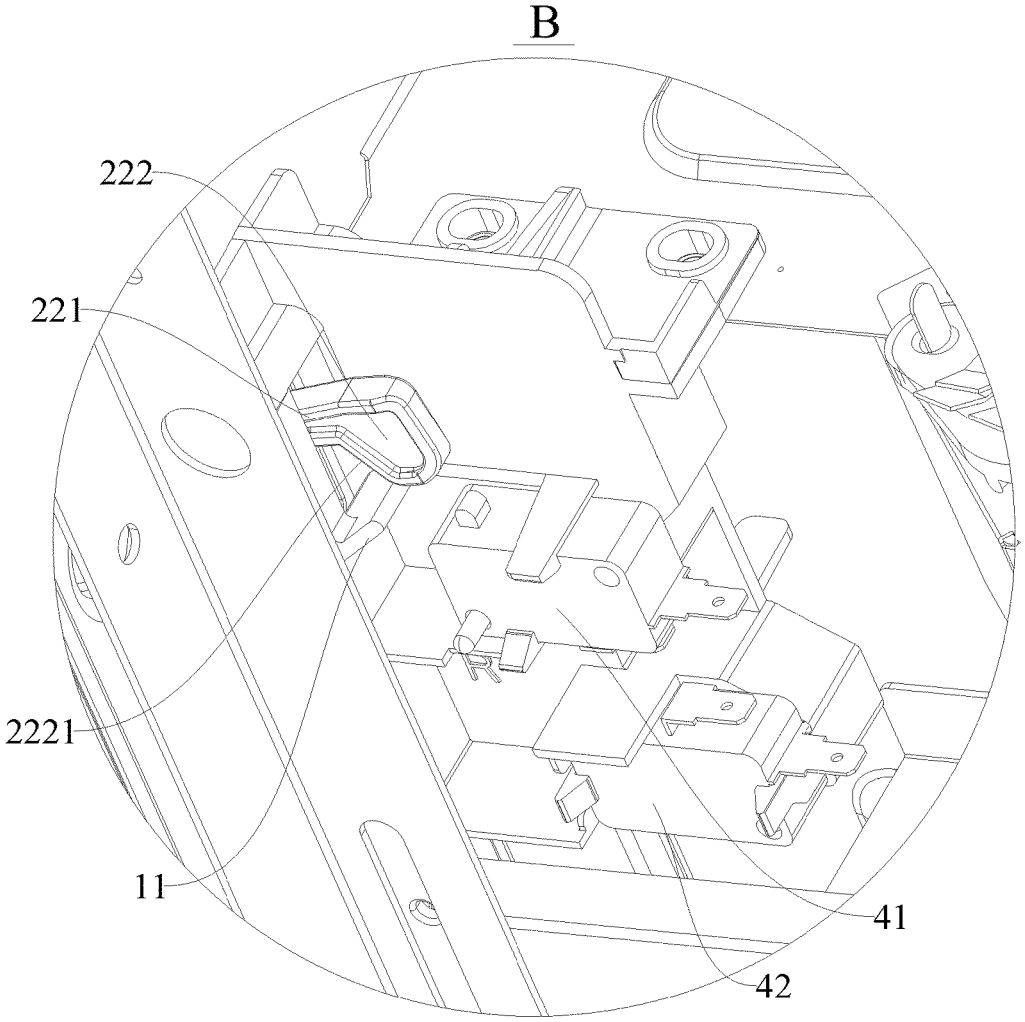
FIG. 4 is a schematic enlarged view showing a B region in FIG. 3.

As shown in FIGS. 3-4, the hook formed into an L-like shape includes a connection part 221 and a snapping part 222, wherein the connection part 221 is connected to the door 21, and the snapping part 222 is connected to the connection part 221 in such a manner that the L-like shape is formed. The snapping part 222, rested against the first microswitch 41 removably, has a slope 2221 engaging with the snapping plate which is inclinedly disposed relative to a vertical direction. Therefore, when the hook is moved under the drive of the drawer 20, the snapping part 222 may be slid along and rested against the snapping plate easily, and may be slid on the snapping plate via the slope 2221 rested against the snapping plate, and thereby to be separated from the snapping plate easily. The hook and the snapping plate not only facilitate the manufacture, but also engage with each other in a secure and easy-to-separate way, and thereby are prevented from being damaged during engaging and separating between the hook and the snapping plate, thus prolonging the product life.

According to some embodiments of the present disclosure, the first microswitch 41 and the second microswitch 42 may be disposed on the interlocking bracket 13, thereby facilitating an assembling operation. Further, as shown in FIGS. 2-9, the interlocking bracket 13 includes a left interlocking bracket 13*a* and a right interlocking bracket 13*b*; the locking component 22 includes a left locking component 22*a* and a right locking component 22*b*; the first microswitch 41 and the second microswitch 42 may be disposed on the right interlocking bracket 13*b*; and the right locking component 22*b* may be rested against the first microswitch 41 removably. The left interlocking bracket 13*a* is provided with a third microswitch 43 which is connected to the drawer driving device 30; and the left locking component 22*a* is rested against the third microswitch 43 removably.

As the third microswitch 43 is of an identical effect to that of the first microswitch 41, the controller 15 may control the drawer driving device 30 to operate by monitoring state changes of the third microswitch 43 and the second microswitch 42, specific operations thereof is not described in detail, which may refer to the description with respect to the first microswitch 41. The left locking component 22*a* and the right locking component 22*b* may be each configured as a door hook; each of the left interlocking bracket 13*a* and the right interlocking bracket 13*b* is provided with the snapping plate; then two door hooks may engage with two snapping plates, respectively, so that the door 21 may be locked better and closed steadily. Meanwhile, two microswitches are disposed to guarantee the door opening or closing operations reliability.

In some specific embodiments of the present disclosure, the oven body 10 may be provided with a control switch connected to the controller 15, so as to control the drawer driving device 30 to operate under the control of the control switch, so that a user may open or close door by operating the control switch conveniently, and thereby the fully automatic door opening or closing operations are realized for the drawer-type microwave oven 100, which makes the door opening or closing operations more flexible and improves the performance.

According to embodiments of the present disclosure, the drawer-type microwave oven 100 may be disposed in a cabinet of furniture. Specifically, the drawer-type microwave oven 100 may be disposed in such a manner that a part of the oven body 10 is inside the cabinet while the other part of the oven body 10 is exposed outside the cabinet, for example, a front side, so as to facilitate the door opening or closing operations. The oven body 10 may be configured as a structure with an open front side, and the drawer 20 may be disposed in the oven body 10 slidably forward and backward. As shown in FIG. 1, the oven body 21 is provided with a handle 211 for convenient operation. The door 21 may also be provided with a transparent window 212 for convenient observation of the oven cavity. A microwave emitter 50 disposed at a back of the oven body 10 has a waveguide 51 leading to the top of the oven body by which microwave is imported into the oven cavity. The drawer 20 may be further provided with a roller in a fixed way; the roller may slide in the guide rail 12, so as to support the drawer 20 and facilitate easy slide of the drawer 20, enabling the drawer 20 to be moved more smoothly.

The oven body 10 may be further provided with a control panel 14 at its front side, and a control switch may be disposed on the control panel 14, so as to facilitate operations. The control switch may be configured as "OPEN" and "CLOSE" buttons on the control panel 14. During performing the fully automatic door opening operation, by the time the computer board acquires an instruction by means of pressing the "OPEN" button on the control panel 14 by a user, a signal is emitted to control the electric motor 31 to be rotated in the forward direction, which controls the pushing rod 33 to move forward via the pusher 32, so as to push the drawer 20.

After putting foods into the drawer 20, the user may press the "CLOSE" button on the control panel 14, then the computer board emits a signal to control the electric motor 31 to rotated in the reverse direction, which controls the pushing rod 33 to move backward via the pusher 32, so that the drawer 20 is controlled to be closed automatically. After the drawer 20 is closed, the right locking component 22*b* is rested against the first microswitch 41 on the right interlocking bracket 13*b*; the left locking component 22*a* is rested against the third microswitch 43 on the left interlocking bracket 13*a*; and the first microswitch 41 and the third microswitch 43 both may emit a signal to the computer board, so as to stop rotating the electric motor, and thereby to accomplish the door closing operations. At this moment, the user may select a corresponding cooking function as personal required.

Manual door opening or closing operations for the drawer-type microwave oven 100 are described hereinafter by taking the drawer-type microwave oven 100 shown in FIGS. 1-9 as an example. For the convenience of description, an action A (assuming a conversion from a closed state into an off-state) and an action B (assuming a conversion from an off-state into a closed state) are introduced.

Figure 5:
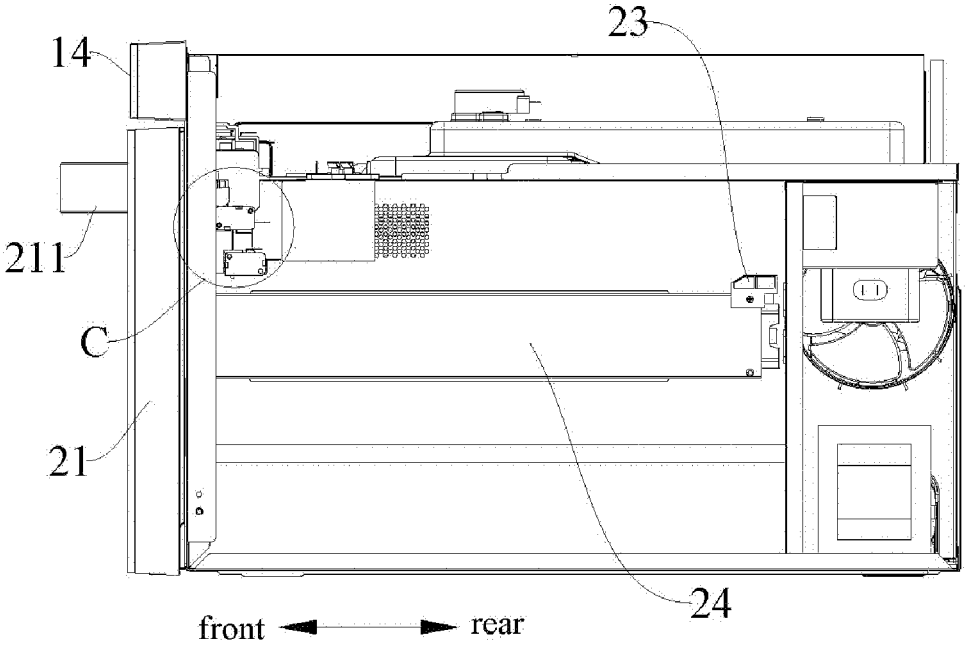
FIG. 5 is a side view showing a drawer-type microwave oven in an opened position according to an embodiment of the present disclosure.
Figure 6:
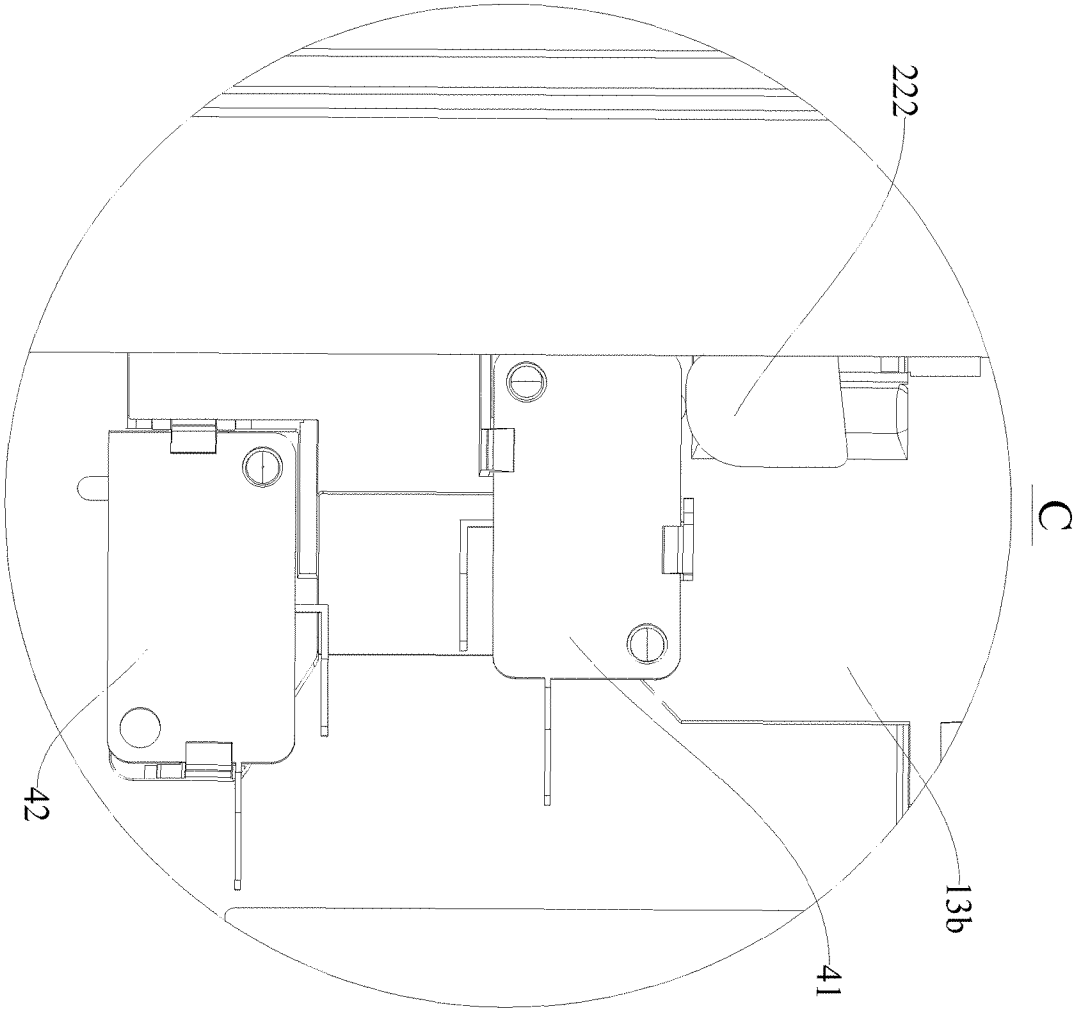
FIG. 6 is a schematic enlarged view showing a C region in FIG. 5.

As shown in FIGS. 5-6, the drawer 20 is in the closed position, and two hooks are rested against the first microswitch 41 and the third microswitch 43, respectively. When the drawer 20 is in such position, it may be determined that the drawer is in the closed position by monitoring states of the first microswitch 41 and the third microswitch 43. At this moment, it is possible to cook foods or perform the door opening operations. In the case that the third microswitch 43 is not provided, it may also be determined that the drawer is in the closed position merely by monitoring the state of the first microswitch 41.

When the drawer 20 is pulled by user's hands, the right locking component 22*b* and the left locking component 22*a* are detached from the first microswitch 41 and the third microswitch 43, respectively, as a result, the first microswitch 41 and the third microswitch 43 perform the action A (or action B), and transmit the signal to the controller 15. After receiving the signal indicating the state of the second microswitch 42 is changed, the controller 15 automatically determines that the use intends to pull the drawer and open door, and controls the drawer driving device 30 to operate, enables the electric motor 31 to be rotated in the forward direction, and enables the drawer 20 to be moved to the opened position. When the drawer 20 is moved to a position where the limiting component 23 is rested against the second microswitch 42, the second microswitch 42 performs the action B (or action A), and transmits the signal to the controller 15. After receiving the signal, the controller 15 determines that the drawer 20 has been fully opened and controls the drawer driving device 30 to stop operating, enables the electric motor 31 to stop rotating, so that the door 21 is maintained at the opened position.

As shown in FIGS. 7-8, the drawer 20 is in the opened position, the right locking component 22*b* is detached from the first microswitch 41, the left locking component 22*a* is detached from the third microswitch 43, at this moment, the user may put foods into the drawer or the like. In such state, the limiting component 23 may be rested against the second microswitch 42.

By then, in the case that the user pushes the drawer 20 by hands, the limiting component 23 may be detached from the second microswitch 42, then the second microswitch 42 performs the action A (or action B), and transmit the signal to the controller 15. After receiving the signal indicating the state of the second microswitch 42 is changed, the controller 15 automatically determines that the use intends to push the drawer and close door and controls the drawer driving device 30 to operate, enables the electric motor 31 to be rotated in the reverse direction, and enables the drawer 20 to be moved to the closed position. When the drawer 20 is moved to a position where the right locking component 22*b* is rested against the first microswitch 41 and the left locking component 22*a* is rested against the third microswitch 43, the first microswitch 41 and the third microswitch 43 perform the action B (or the action A), and transmit the signal to the controller 15. After receiving the signal, the controller 15 determines that the drawer 20 has been fully closed, and controls the drawer driving device 30 to stop operating, enables the electric motor 31 to stop rotating, so that the door 21 is maintained at the closed position, i.e., the door closing operations are accomplished. At this moment, the user may select the cooking, stand-by or power-off function.

In conclusion, with the drawer-type microwave oven 100 according to embodiments of the present disclosure, it is possible to determine the location where the drawer 20 is located by the microswitch, and to determine the user's intention by means of monitoring the microswitch action from the off-state to the closed state, or from the closed state to the off-state, so as to open or close the drawer 20, perform the automatic door opening or closing operations steadily, facilitate the door opening or closing operations, and reduce cost, such as reducing the number of receivers and changing the particular electric motor into a general electric motor.

Other structures and operations of the drawer-type microwave oven 100 according to embodiments of the present disclosure are known to those ordinary technicians, which will not be described in detail herein.

In this specification, it should be understood that, the terms such as "above", "below", "front", "rear", "left", "right", "top", "bottom", "inner" and "outer" should be construed to refer to the a orientation or position relationship as then described or as shown in the drawings. These terms are merely for convenience and concision of description and do not alone indicate or imply that the device or element referred to must have a particular orientation, or be constructed and operated in particular orientation. Thus, it cannot be understood to limit the present disclosure.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via intervening structures.

Reference throughout this specification to "an embodiment", "some specific embodiments", "one embodiment", "another example", "an example", "a specific example" or "some examples" means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A drawer-type microwave oven, comprising:

an oven body, defining an oven cavity therein, and provided with a first microswitch, a second microswitch and a locking engagement component thereon;

a drawer, connected to the oven body, disposed in the oven cavity and between a closed position and an opened position in a push-pull way, provided with a door at an end of the drawer for driving the door to open or close the oven cavity, and provided with a locking component rested against the first microswitch removably and a limiting component rested against the second microswitch removably, the locking component being arranged on an inner wall of the door, and the locking engagement component being arranged in a front of the oven cavity, the locking component engaging with the locking engagement component to lock the door;

a drawer driving device, connected to the drawer; and a controller, electrically connected to the drawer driving device, the first microswitch and the second microswitch respectively, and configured to control the drawer driving device to drive the drawer to be pushed into or pulled out of the oven cavity by monitoring state changes of the first microswitch and the second microswitch.

2. The drawer-type microwave oven according to claim 1, wherein when the drawer is moved to the closed position, so that the locking component is rested against the first microswitch so as to close the first microswitch and the controller controls the drawer driving device to stop moving; and when the drawer is moved to the opened position from the closed position, the locking component is detached from the locking engagement component, so that the first microswitch is shut off and the controller controls the drawer driving device to drive the drawer to be pulled out of the oven cavity; or when the drawer is moved to the opened position, the limiting component is rested against the second microswitch so as to close the second microswitch, so that the controller controls the drawer driving device to stop moving; and when the drawer is moved to the closed position from the opened position, the limiting component is detached from the second microswitch, so that the second microswitch is shut off and the controller controls the drawer driving device to drive the drawer to be pushed into the oven cavity.

3. The drawer-type microwave oven according to claim 1, wherein when the drawer is moved to the closed position, so that the locking component is rested against the first microswitch so as to shut off the first microswitch and the controller controls the drawer driving device to stop moving; and when the drawer is moved to the opened position from the closed position, the locking component is detached from the locking engagement component, so that the first microswitch is closed and the controller controls the drawer driving device to drive the drawer to be pulled out of the oven cavity; or when the drawer is moved to the opened position, the limiting component is rested against the second microswitch so as to shut off the second microswitch, so that the controller controls the drawer driving device to stop moving; and when the drawer is moved to the closed position from the opened position, the limiting component is detached from the second microswitch, so that the second microswitch is closed and the controller controls the drawer driving device to drive the drawer to be pushed into the oven cavity.

4. The drawer-type microwave oven according to claim 2, wherein the drawer driving device comprises:

an electric motor, connected to the controller, so as to be rotated in a forward or reverse direction under a control of the controller;

a pusher, connected to the electric motor; and a pushing rod, connected to the pusher and the drawer, so as to drive the drawer to be moved.

5. The drawer-type microwave oven according to claim 2, wherein the oven body is provided with a guide rail thereon, the drawer is provided with a guide rail connecting plate thereon, and the guide rail connecting plate is connected to the guide rail slidably.

6. The drawer-type microwave oven according to claim 5, wherein the limiting component is disposed on the guide rail connecting plate.

7. The drawer-type microwave oven according to claim 2, wherein the locking component is configured as a hook, the oven body is provided with an interlocking bracket thereon, and the locking engagement component is disposed on the interlocking bracket and configured as a snapping plate.

8. The drawer-type microwave oven according to claim 7, wherein the hook, formed into an L-like shape, comprises a connection part and a snapping part, wherein the connection part is connected to the door; and the snapping part is rested against the first microswitch removably, has a slope engaging with the snapping plate which is inclinedly arranged relative to a vertical direction.

9. The drawer-type microwave oven according to claim 7, wherein the first microswitch and the second microswitch are disposed on the interlocking bracket.

10. The drawer-type microwave oven according to claim 9, wherein the interlocking bracket comprises a left interlocking bracket and a right interlocking bracket, the locking component comprises a left locking component and a right locking component, the first microswitch and the second microswitch are disposed on the right interlocking bracket, the right interlocking bracket is rested against the first microswitch removably, the left interlocking bracket is provided with a third microswitch connected to the controller, and the left interlocking bracket is rested against the third microswitch removably.

11. The drawer-type microwave oven according to claim 2, wherein the oven body is provided with a control switch connected to the controller, so as to control the drawer driving device to operate under a control of the control switch.

12. The drawer-type microwave oven according to claim 3, wherein the drawer driving device comprises:

an electric motor, connected to the controller, so as to be rotated in a forward or reverse direction under a control of the controller;

a pusher, connected to the electric motor; and a pushing rod, connected to the pusher and the drawer, so as to drive the drawer to be moved.

13. The drawer-type microwave oven according to claim 3, wherein the oven body is provided with a guide rail thereon, the drawer is provided with a guide rail connecting plate thereon, and the guide rail connecting plate is connected to the guide rail slidably.

14. The drawer-type microwave oven according to claim 13, wherein the limiting component is disposed on the guide rail connecting plate.

15. The drawer-type microwave oven according to claim 3, wherein the locking component is configured as a hook, the oven body is provided with an interlocking bracket thereon, and the locking engagement component is disposed on the interlocking bracket and configured as a snapping plate.

16. The drawer-type microwave oven according to claim 15, wherein the hook, formed into an L-like shape, comprises a connection part and a snapping part, wherein the connection part is connected to the door; and the snapping part is rested against the first microswitch removably, has a slope engaging with the snapping plate which is inclinedly arranged relative to a vertical direction.

17. The drawer-type microwave oven according to claim 15, wherein the first microswitch and the second microswitch are disposed on the interlocking bracket.

18. The drawer-type microwave oven according to claim 17, wherein the interlocking bracket comprises a left interlocking bracket and a right interlocking bracket, the locking component comprises a left locking component and a right locking component, the first microswitch and the second microswitch are disposed on the right interlocking bracket, the right interlocking bracket is rested against the first microswitch removably, the left interlocking bracket is provided with a third microswitch connected to the controller, and the left interlocking bracket is rested against the third microswitch removably.

19. The drawer-type microwave oven according to claim 3, wherein the oven body is provided with a control switch connected to the controller, so as to control the drawer driving device to operate under a control of the control switch.

* * * * *